US011585068B2

(12) United States Patent
Nakajima

(10) Patent No.: US 11,585,068 B2
(45) Date of Patent: Feb. 21, 2023

(54) BOOM CONTROL SYSTEM FOR A CONSTRUCTION MACHINE

(71) Applicant: Caterpillar SARL, Geneva (CH)

(72) Inventor: Hideki Nakajima, Akashi (JP)

(73) Assignee: Caterpillar SARL, Geneva (CH)

( * ) Notice: Subject to any disclaimer, the term of this patent is extended or adjusted under 35 U.S.C. 154(b) by 479 days.

(21) Appl. No.: 16/620,727

(22) PCT Filed: Jun. 19, 2018

(86) PCT No.: PCT/EP2018/066313
§ 371 (c)(1),
(2) Date: Dec. 9, 2019

(87) PCT Pub. No.: WO2018/234339
PCT Pub. Date: Dec. 27, 2018

(65) Prior Publication Data

US 2020/0199842 A1 Jun. 25, 2020

(30) Foreign Application Priority Data

Jun. 19, 2017 (JP) ..... JP2017-119561

(51) Int. Cl.
*E02F 3/43* (2006.01)
*E02F 9/22* (2006.01)

(52) U.S. Cl.
CPC ..... *E02F 3/435* (2013.01); *E02F 9/2217* (2013.01); *E02F 9/2221* (2013.01); *E02F 9/2282* (2013.01); *E02F 9/2292* (2013.01)

(58) Field of Classification Search
CPC ..... F15B 11/024; F15B 13/021; F15B 2011/0243; E02F 3/435; E02F 9/2221
See application file for complete search history.

(56) References Cited

U.S. PATENT DOCUMENTS 7,451,685 B2 * 11/2008 Tabor ..... F15B 21/14 91/361
10,428,491 B2 * 10/2019 Joung ..... E02F 9/2282
(Continued)

FOREIGN PATENT DOCUMENTS

CN 102061714 5/2011
JP 2005-221026 A 8/2005
(Continued)

OTHER PUBLICATIONS

International Search Report for related International Application No. PCT/EP2018/066313 dated Oct. 4, 2018.

*Primary Examiner* — Abiy Teka

(57) ABSTRACT

To be capable of dealing with a machine body lifting operation or a sudden operation, while improving energy efficiency, during a boom-lowering operation, and achieving the reduction of the number of parts, in a construction machine equipped with a boom. It is configured such that a first region Y1 at which a recovery valve passage 16*e* is opened and a supply valve passage 16*f* is closed and a second region Y2 at which the recovery valve passage 16*e* and the supply valve passage 16*f* are opened, are provided at an operating position of a first boom control valve 16 during the boom lowering operation, and the first boom control valve 16 is positioned at the first region Y1 when neither a machine body lifting operation nor the sudden operation is performed during the boom-lowering operation, and at the region Y2 when the machine body lifting operation or the sudden operation is performed.

4 Claims, 10 Drawing Sheets

(56) References Cited

U.S. PATENT DOCUMENTS

| | | | | |
|---|---|---|---|---|
| 2006/0162443 | A1* | 7/2006 | Drummond | F16K 99/0009 73/276 |
| 2016/0333551 | A1* | 11/2016 | Joung | E02F 9/2207 |

FOREIGN PATENT DOCUMENTS

| | | | |
|---|---|---|---|
| JP | 2008101414 | | 5/2008 |
| JP | 2010-275818 | A | 12/2010 |
| WO | WO 2009/084853 | A2 | 7/2009 |

* cited by examiner

BOOM CONTROL SYSTEM FOR A CONSTRUCTION MACHINE

CROSS-REFERENCE TO RELATED APPLICATION

This Application is a 35 USC § 371 US National Stage filing of International Application No. PCT/EP2018/066313 filed on Jun. 19, 2018 which claims priority under the Paris Convention to the Japanese Patent Application No. 2017-119561 filed on Jun. 19, 2017.

TECHNICAL FIELD

The present invention relates to the technical field of a boom control system in a construction machine equipped with a boom that vertically moves based on an extending and contracting operation of a boom cylinder.

BACKGROUND ART

Generally, among construction machines, there are some such as hydraulic shovels, which are configured such that a front work implement mounted on a machine body includes a boom with a base end portion being supported on the machine body in a vertically movable manner, a stick supported on a leading end portion of the boom in a longitudinally swingable manner, a working attachment such as a bucket attached to the leading end of the stick, and the boom is vertically moved based on an extending and contracting operation of a boom cylinder. In this construction machine, when the boom is lowered in the air (when lowering the boom in a state where the working attachment is not touching down the ground), the weight of the front work implement placed on the boom directly acts as a force for contracting the boom cylinder, and as a result, the pressure of oil discharged from the head end oil chamber becomes high, while pressurized oil supplied to the rod end oil chamber may be oil even at a low pressure. Therefore, conventionally, there is widely used a technique of providing a recovery oil passage for supplying the oil discharged from the head end oil chamber of the boom cylinder to the rod end oil chamber when the boom is lowered. By providing such a recovery oil passage, the flow rate of the pressurized oil to be supplied from the hydraulic pump to the rod end oil chamber can be reduced or made unnecessary, thereby contributing to the improvement of the energy efficiency. Furthermore, if it becomes unnecessary to supply the pressurized oil to the boom cylinder from the hydraulic pump during the boom-lowering operation, then when an interlocking operation (combined operation) is performed between the boom cylinder and other hydraulic actuators (for example, a stick cylinder for causing the stick to swing) which uses the same hydraulic pump as the boom cylinder as the pressurized oil supply source, the influence of the pressurized oil supply to the boom cylinder on the behavior of the other hydraulic actuators can be surely eliminated, and thus there is also an advantage of improving operability.

However, when the boom-lowering operation is performed, highly pressurized oil from the hydraulic pump must be supplied in some cases to the rod end oil chamber of the boom cylinder. For example, when performing a machine body lifting operation (for example, in a hydraulic shovel, in case of escaping from a dent or soft ground or the like, an operation of causing the boom to be relatively lowered with respect to the machine body by performing the boom-lowering operation while the bucket is touching down the ground, thereby lifting a part of the machine body), the boom cylinder is contracted while resisting the weight of the machine body, and consequently it is necessary to supply highly pressurized oil to the rod end oil chamber of the boom cylinder. Even when the boom is lowered in the air, alone the pressurized oil supply from the head end oil chamber to the rod end oil chamber using the recovery oil passage makes an acceleration of the boom cylinder slower compared with the case where the pressurized oil supply from the hydraulic pump is also performed. As a result, there arises a problem that the responsiveness is inferior when an operator suddenly operates the boom operating lever.

Thus, conventionally, there is known a technique of providing a meter-in circuit (for example, see Patent Literatures 1 and 2), wherein only the recovered oil from the head end oil chamber is supplied to the rod end oil chamber, when the pressure of the head end oil chamber of the boom cylinder is equal to or higher than the predetermined pressure during the boom-lowering operation, while the discharge oil from the hydraulic pump is supplied to the rod end oil chamber, when the pressure of the head end oil chamber is lower than a predetermined pressure. These construction machines are configured such that only the recovered oil is used when the boom is lowered in the air, while the pressurized oil from the hydraulic pump is also supplied to the rod end oil chamber when the machine body is lifted.

PRIOR ART LITERATURES

Patent Literatures

[PATENT LITERATURE 1] Japanese Patent Application Laid-Open No. 2005-221026

[PATENT LITERATURE 2] Japanese Patent Application Laid-Open No. 2010-275818

SUMMARY OF THE INVENTION

Problems to be Solved by the Invention

However, the construction machines of the Patent Literature 1 require a flow passage changing means (flow rate control valves and center bypass switching valves) for switching flow passages between a case where discharge oil from a hydraulic pump is supplied to a rod end oil chamber of a boom cylinder and a case where not supplied, and valves such as jack up switching valves etc. for operating the flow passage changing means, in addition to a direction switching valve for controlling the flow of pressurized oil to a boom cylinder, and the circuit is also complicated. Also, the construction machines of the Patent Literature 2 require a direction switching valve for supplying the discharge oil of a hydraulic pump to the rod end oil chamber only when the machine body is lifted (when jacking-up), and valves such as a jack up electromagnetic proportional valve for switching the direction switching valve and have a problem that the number of parts is large, and cost reduction and space saving are hindered. Further, the construction machines in Patent Literatures 1 and 2 each have not been examined about responsiveness when an operator suddenly operates the boom operating lever to the boom lowering-side, and there are problems to be solved by the present invention in these aspects.

Means for Solving the Problem

The present invention has been created with an aim of solving these problems in view of the actual circumstances as discussed above. The invention of claim 1 is a boom control system in a construction machine, the construction machine being configured to include a boom that vertically moves based on extending and contracting operation of a boom cylinder, wherein a recovery oil passage that allows oil discharged from a head end oil chamber to be supplied to a rod end oil chamber of a boom cylinder during a boom lowering operation, an a discharge oil passage that allows oil discharged from the head end oil chamber of the boom cylinder to flow into an oil tank, and a supply oil passage that allows discharge oil of a hydraulic pump to be supplied to the rod end oil chamber are provided, and in providing a supply valve passage that controls the flow rate of the supply oil passage, on a boom control valve for controlling the flow rate of the recovery oil passage or the discharge oil passage, a pressure detecting means for detecting a pressure in the head end oil chamber of the boom cylinder, an operation detecting means for detecting an operation of the boom, and a controller for controlling the boom control valve based on input signals from these pressure detecting means and the operation detecting means are provided, and the boom control valve is provided with a first region at which the supply valve passage is closed and a second region at which the supply valve passage is opened, in an operating position during boom-lowering operation, and on the other hand, the controller determines whether the operation is a machine body lifting operation for lifting a part of the machine body based on a pressure of the head end oil chamber during boom lowering operation, and if it is determined that the operation is not a machine body lifting operation, the boom control valve is positioned at the first region, and if it is determined that the operation is a machine body lifting operation, the boom control valve is positioned at the second region.

The invention of claim 2 is A boom control system in a construction machine, the construction machine being configured to include a boom that moves up and down based on extending and contracting operation of a boom cylinder, wherein a recovery oil passage that allows oil discharged from a head end oil chamber to be supplied to a rod end oil chamber of a boom cylinder during a boom lowering operation, an a discharge oil passage that allows oil discharged from the head end oil chamber of the boom cylinder to flow into an oil tank, and a supply oil passage that allows discharge oil of a hydraulic pump to be supplied to the rod end oil chamber are provided, and in providing a supply valve passage that controls the flow rate of the supply oil passage, on a boom control valve for controlling the flow rate of the recovery oil passage and the discharge oil passage, a pressure detecting means for detecting a pressure in the head end oil chamber of the boom cylinder, an operation detecting means for detecting an operation of the boom, and a controller for controlling the boom control valve based on input signals from these pressure detecting means and the operation detecting means are provided, and the boom control valve is provided with a first region at which the supply valve passage is closed and a second region at which the supply valve passage is opened, in an operating position during boom-lowering operation, and on the other hand, the controller determines whether the operation is a machine body lifting operation for lifting a part of the machine body based on a pressure of the head end oil chamber during boom lowering operation, and if it is determined that the operation is not a machine body lifting operation, the boom control valve is positioned at the first region, and if it is determined that the operation is a machine body lifting operation, the boom control valve is positioned at the second region.

The invention of claim 3 is the boom control system in the construction machine, according to claim 1 or claim 2, wherein the controller, if the boom-lowering operation is a sudden operation, causes the boom control valve to be positioned at the second region, irrespective of determination whether the operation is a machine body lifting operation.

Favorable Effects of the Invention

According to a first aspect of the present invention, the boom control system can contribute to an improvement in energy efficiency, and besides can perform smoothly a lifting operation of the machine body, and also can perform switching between a case of supplying and a case of not supplying the discharge oil of a hydraulic pump to a rod end oil chamber during lowering operation of the boom can be performed, by providing a first region and a second region in a boom control valve which controls the flow rate of recovery oil passage or discharge oil passage during lowering operation of the boom, thereby eliminating the need for dedicated valves for performing the aforementioned switching and solenoid valves etc. for operating the valves, and thus enabling contribution to reduction in the number of parts, and contribution to space saving.

According to a second aspect of the present invention, the boom control system can contribute to an improvement in energy efficiency, and besides can perform smoothly a lifting operation of the machine body, and also can perform switching between a case of supplying and a case of not supplying the discharge oil of a hydraulic pump to a rod end oil chamber during lowering operation of the boom can be performed, by providing a first region and a second region in a boom control valve which controls the flow rate of recovery oil passage or discharge oil passage during lowering operation of the boom, thereby eliminating the need for dedicated valves for performing the aforementioned switching and solenoid valves etc. for operating the valves, and thus enabling contribution to reduction in the number of parts, and contribution to space saving.

According to a third aspect of the present invention, the boom control system is excellent in responsiveness in case where the boom lowering operation is suddenly operated.

BRIEF DESCRIPTION OF THE DRAWINGS

FIGS. 3A to 3C are diagrams illustrating the first embodiment, in which FIG. 3A is a diagram explaining a first region at a lowering-side operating position of a first boom control valve, FIG. 3B is a diagram explaining a second region at a lowering-side operating position of a first control valve for the boom, and FIG. 3C is a diagram explaining a lowering operating position of a second boom control valve.

FIGS. 4A and 4B are diagrams illustrating the first embodiment, in which FIG. 4A is a diagram explaining opening characteristics of the first and second regions in the lowering-side operating position of the first boom control valve, and FIG. 4B is a diagram explaining opening characteristics of the lowering-side operating position of the second boom control valve.

FIGS. 6A to 6C are diagrams illustrating the second embodiment, in which FIG. 6A is a diagram explaining the lowering operating position of a first boom control valve, FIG. 6B is a diagram explaining a first region at the lowering-side operating position of a second control valve for the boom, and FIG. 6C is a diagram explaining a second region at the lowering-side operating position of the second boom control valve.

FIGS. 7A and 7B are diagrams illustrating the second embodiment, in which, FIG. 7A is a diagram explaining opening characteristics of a lowering-side operating position of the first boom control valve, and FIG. 7B is a diagram explaining opening characteristics of the first, and second regions of the lowering-side operating position of the second boom control valve.

FIGS. 9A and 9B are diagrams illustrating the third embodiment, in which FIG. 9A is a diagram explaining a first region at the lowering-side operating position of a boom control valve, FIG. 9B is a diagram explaining a second region at the lowering-side operating position of the boom control valve.

DETAILED DESCRIPTION OF THE INVENTION

Hereinafter, embodiments of the present invention will be discussed with reference to the drawings.

Figure 1:
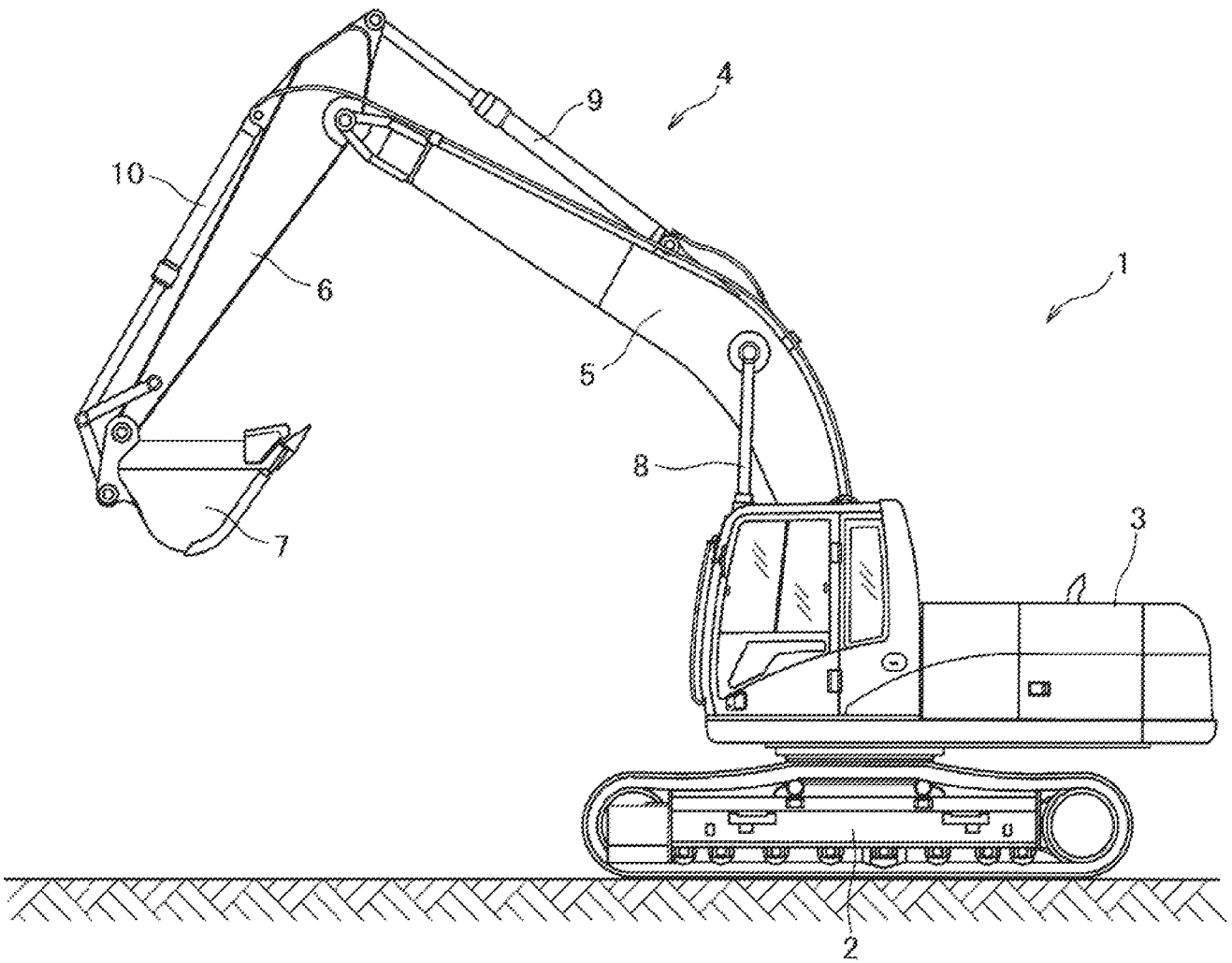
FIG. 1 is a side view of a hydraulic shovel.

First, a first embodiment of the present invention will be discussed with reference to FIGS. 1 to 4. FIG. 1 is a view illustrating a hydraulic shovel 1, which is an example of a construction machine of the present invention, includes various components such as a crawler-type lower traveling body 2; an upper rotating body 3 rotatably supported above the lower traveling member 2, a front work implement 4 mounted on the upper rotating body 3. In addition, the front work implement 4 includes a boom 5 with a base end portion being supported vertically swingably on the upper rotating body 3; a stick 6 supported longitudinally swingably to a leading end portion of the boom 5; and a bucket 7 attached to a leading end portion of the stick 6. The hydraulic shovel 1 is provided with various types of hydraulic actuators such as a boom cylinder 8; a stick cylinder 9; and a bucket cylinder 10 for causing the boom 5; the stick 6; and the bucket 7 to swing respectively; left and right traveling motors (not shown) for causing the lower traveling body 2 to travel; a rotating motor (not shown) for rotating the upper rotating body 3. The configuration of the hydraulic shovel 1 in the second and third embodiments as discussed below is similar to that in the first embodiment, and FIG. 1 is shared with the first to third embodiments.

Figure 2:
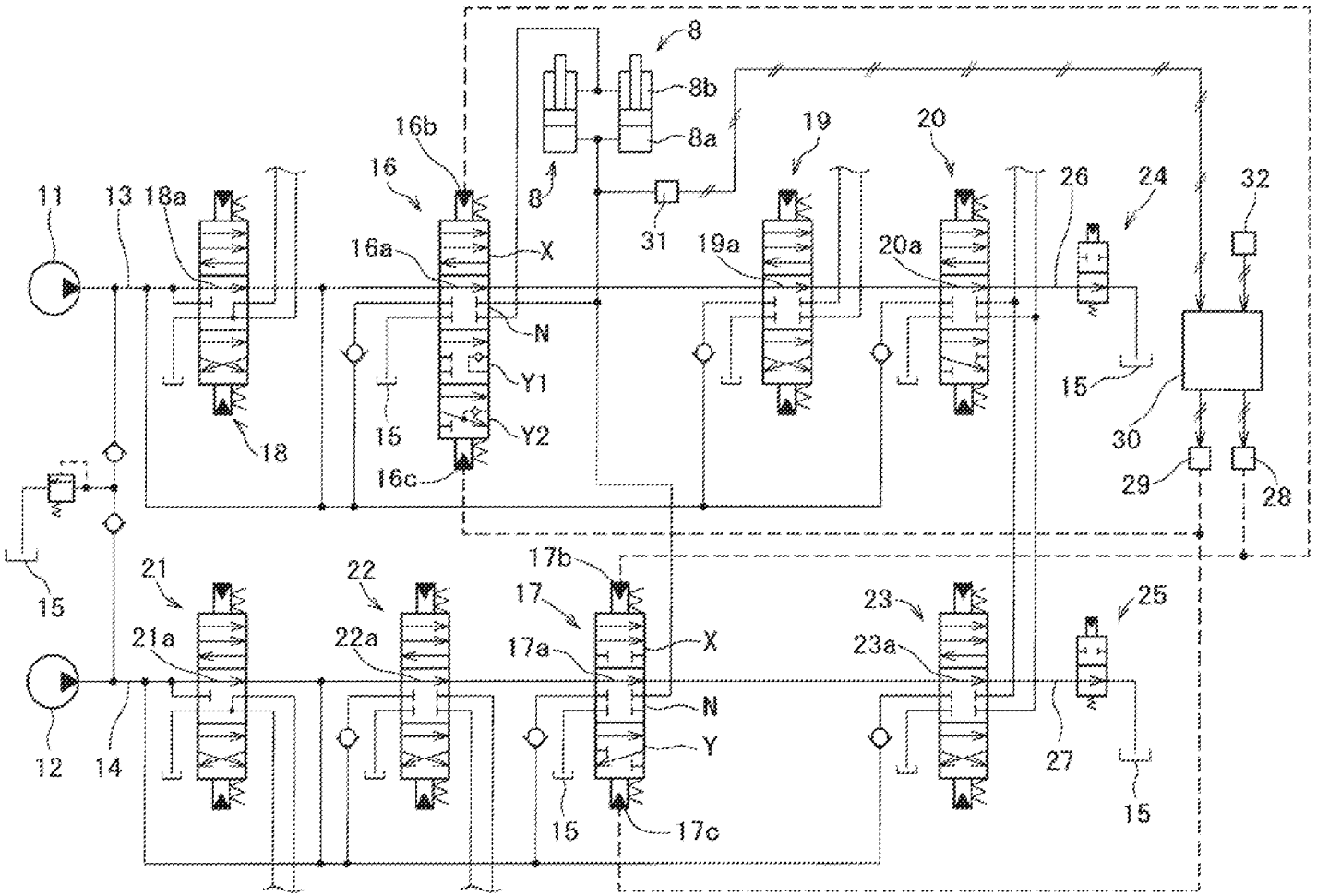
FIG. 2 is a hydraulic control circuit diagram of a boom cylinder in a first embodiment.
Figure 3C:
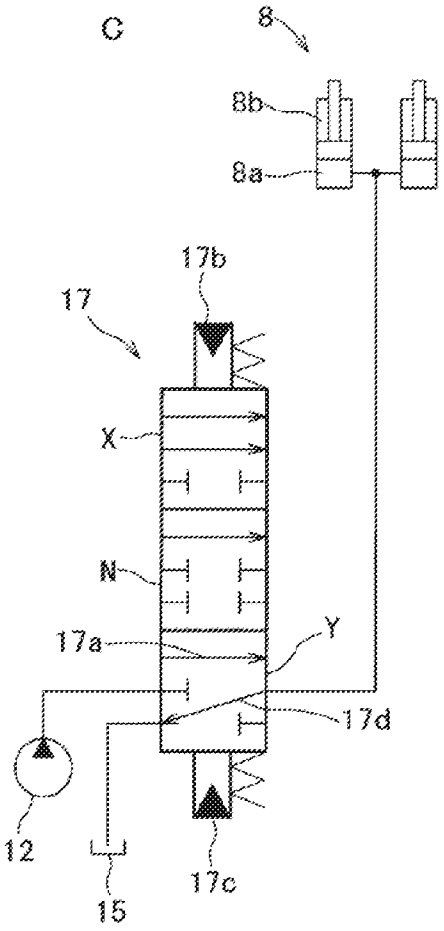
Figure 3B:
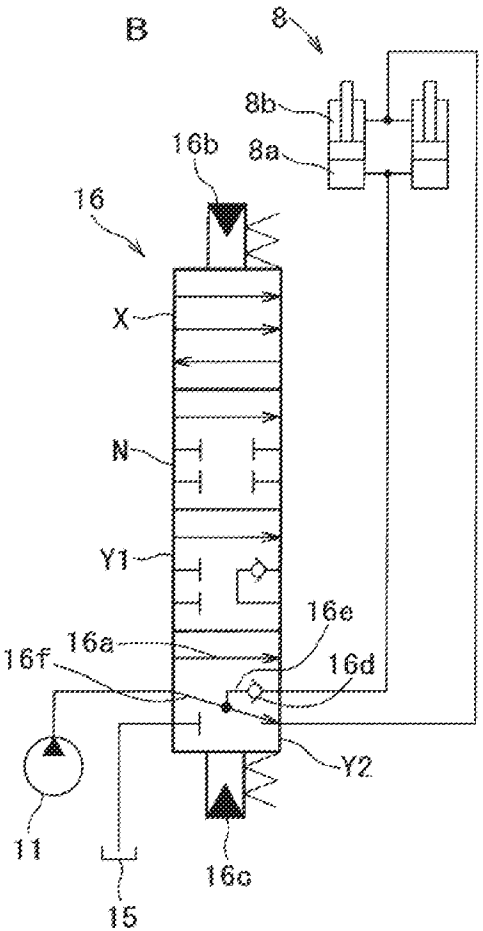
Figure 3A:
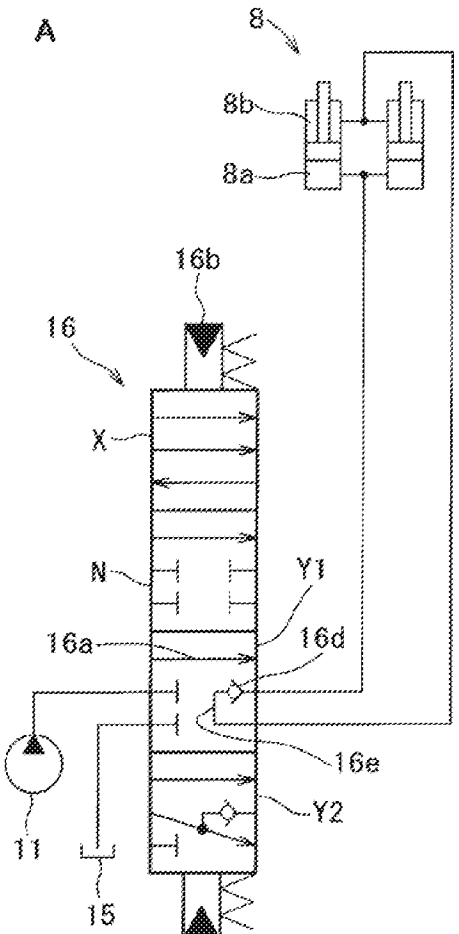

The boom cylinder 8 causes the boom 5 to be raised by extending the cylinder by supply of pressurized oil to the head end oil chamber 8*a* and discharge of oil from the rod end oil chamber 8*b*, and on the other hand, causes the boom 5 to be lowered by retracting the cylinder by supply of pressurized oil to the rod end oil chamber 8*b* and discharge of oil from the head end oil chamber 8*a*. The control of supply and discharge of pressurized oil to and from the boom cylinder 8 will be discussed based on the hydraulic control circuit diagram as illustrated in FIG. 2. In FIG. 2, reference numerals 11 and 12 denote first and second hydraulic pumps serving as pressurized oil supply sources of the boom cylinder 8; reference numerals 13 and 14 denote first and second hydraulic pump oil passages to which the discharge oil of the first and second hydraulic pumps 11 and 12 is respectively supplied; reference numeral 15 denotes an oil tank; 16 and 17 denote first and second boom control valves for performing supply and discharge control of oil to and from the boom cylinder 8, and the first boom control valve 16 is connected to the first pump oil passage 13, the second boom control valve 17 is connected to the second pump oil passage 14, respectively.

In the above FIG. 2, reference numerals 18, 19 and 20 denote a left traveling control valve, a bucket control valve and a first stick control valve each connected to the first pump oil passage 13; 21, 22 and 23 denote a right traveling control valve, a rotating control valve, and a second stick control valve each connected to the second pump oil passage 14. These control valves 18 to 23 switch from a neutral position to an operating position in response to an operation of the respective corresponding operation implements and performs supply and discharge control of oil to and from the corresponding hydraulic actuators (the left and right traveling motors, the rotating motor, the stick cylinder 9, and the bucket cylinder 10), but the detailed description of these control valves 18 to 23 will be omitted. Reference numerals 24 and 25 denote first and second center bypass control valves, the first center bypass control valve 24 performs flow rate control of a first center bypass oil passage 26 that extends from the first hydraulic pump 11 to the oil tank 15 sequentially passing through center bypass valve passages 18*a*, 16*a*, 19*a*, 20*a* formed in the respective control valves 18, 16, 19 and 20 connected to the first pump oil passage 13. Also, the second center bypass control valve 25 performs flow rate control of a second center bypass oil passage 27 that extends from the second hydraulic pump 12 to the oil tank 15 sequentially passing through center bypass valve passages 21*a*, 22*a*, 17*a*, 23*a* formed in the respective control valves 21, 22, 17, 23 connected to the second pump oil passage 14. A detailed description of these first and second center bypass control valves 24 and 25 will be also omitted.

The first boom control valve 16 is a four-position switching spool valve that includes raising-side and lowering-side pilot ports 16*b* and 16*c*. When a pilot pressure is not input to both the pilot ports 16*b* and 16*c*, the first boom control valve 16 is positioned at a neutral position N so as not to allow pressurized oil to be supplied to or discharged from the boom cylinder 8. However, when a pilot pressure is input to the raising-side pilot port 16*b*, the first boom control valve 16 switches to be positioned at a raising-side operating position X so as to allow discharge oil from the first hydraulic pump 11 to be supplied to the head end oil chamber 8*a* of the boom cylinder 8 and oil discharged from the rod end oil chamber 8*b* to flow into the oil tank 15. When a pilot pressure is input to the lowering-side pilot port 16*c*, the first boom control valve 16 switches to be positioned at a lowering-side operating position Y, but a first region Y1 and a second region Y2 are provided in the lowering-side operating position Y. In this case, the second region Y2 is set up at a position at which the amount of displacement from the neutral position N is larger than that of the first region Y1. In a state where the boom cylinder 8 is positioned at the first region Y1, a recovery valve passage 16*e* for supplying the oil discharged from the head end oil chamber 8*a* of the boom cylinder 8 to the rod end oil chamber 8*b* via a check valve 16*d* is opened, and on the other hand, a supply valve passage 16*f* that allows the discharge oil of the first hydraulic pump 11 to be supplied to the rod end oil chamber 8*b* is closed (see FIG. 3A). In a state where the boom cylinder 8 is positioned at the second region Y2, the recovery valve passage 16*e* that allows the oil discharged from the head end oil chamber 8*a* to be supplied to the rod end oil chamber 8*b* via the check valve 16*d*, and the supply valve passage 16*f* that allows the discharge oil of the first hydraulic pump 11 to be supplied to the rod end oil chamber 8*b* is opened (See FIG. 3B).

On the other hand, the second boom control valve 17 is a three-position switching spool valve that includes raising-side and lowering-side pilot ports 17*b* and 17*c*. In a state where a pilot pressure is not input to both the pilot ports 17*b* and 17*c*, the second boom control valve 17 is positioned at a neutral position N at which supply and discharge of pressurized oil to and from the boom cylinder 8 is not performed. When a pilot pressure is input to the raising-side pilot port 17*b*, the second boom control valve 17 switches to be positioned at the raising-side operating position X to allow the discharge oil of the second hydraulic pump 12 to be supplied to the head end oil chamber 8*a* of the boom cylinder 8. When a pilot pressure is input to the lowering-side pilot port 17*c*, the second boom control valve 17 switches to be positioned at the lowering-side operating position Y. However, in a state where the second boom control valve 17 is positioned at the lowering-side operating position Y, a discharge valve passage 17*d* that allow the oil discharged from the head end oil chamber 8*a* of the boom cylinder 8 to flow into the oil tank 15 is opened (See FIG. 3C).

In the first embodiment, the first boom control valve 16 corresponds to the boom control valve of the present invention, and the second boom control valve does not correspond to the boom control valve of the present invention. In the above FIGS. 3A, 3B and 3C, oil passages connected to the center bypass valve passages 16*a* and 17*a* of the first boom and the second boom control valves 16 and 17 will be omitted.

Figure 4B:
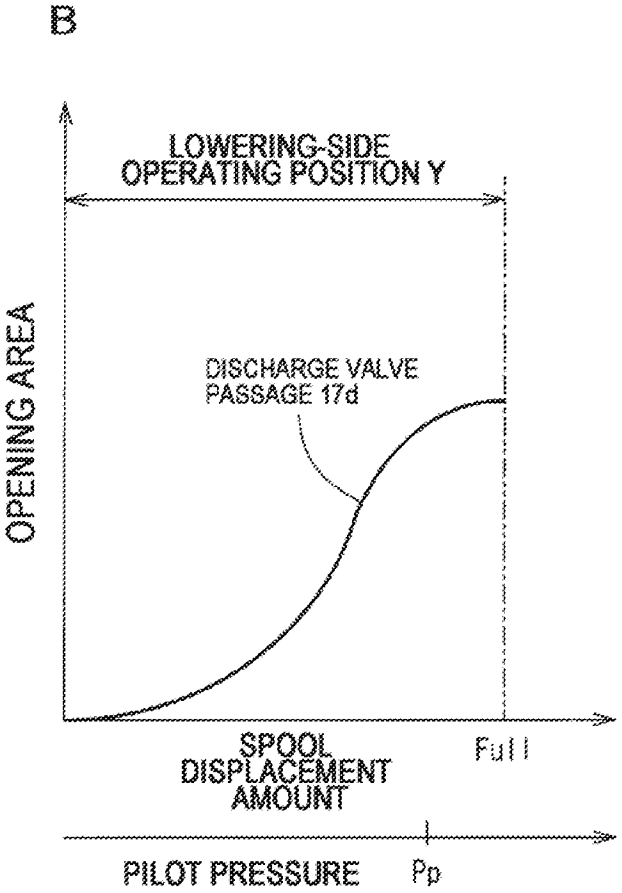
Figure 4A:
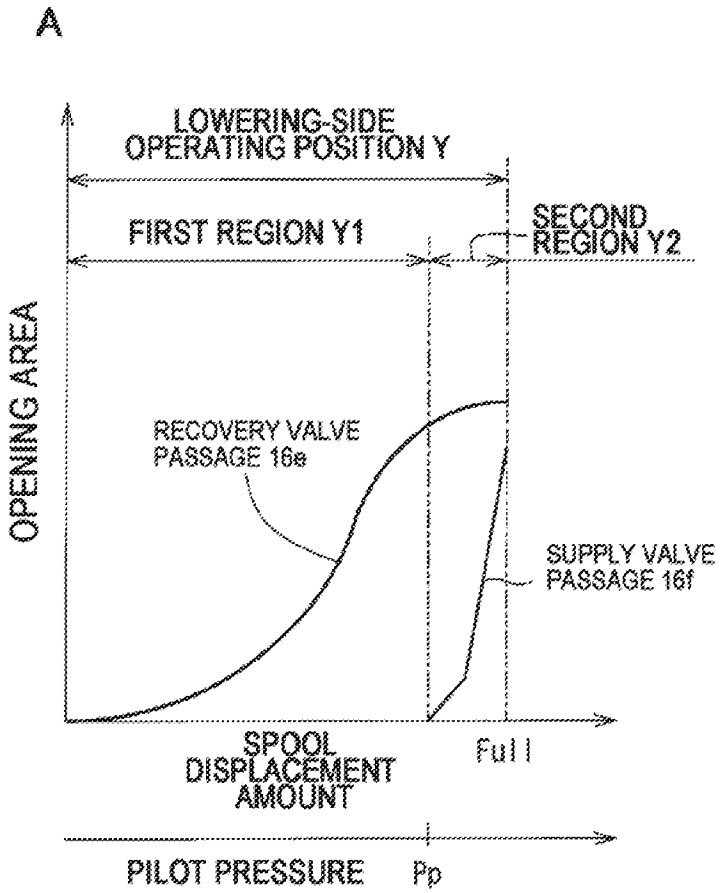

Here, the opening characteristics of the recovery valve passage 16*e* and the supply valve passage 16*f* when the first boom control valve 16 is positioned at the first region Y1 and the second region Y2 of the lowering-side operating position Y are illustrated in FIG. 4A. As illustrated in FIG. 4A, at the first region Y1, only the recovery valve passage 16*e* is opened, and the more a spool displacement amount increases, the more an opening area is set to increase. Further, when the spool is further displaced beyond the first region Y1 to reach the second region Y2, the opening area of the recovery valve passage 16*e* increases even more and the supply valve passage 16*f* is opened, but the more a spool displacement amount increases, the more an opening area of the supply valve passage 16*f* is set to increase. The recovery flow rate from the head end oil chamber 8*a* to the rod end oil chamber 8*b*, and the recovery flow rate from the first hydraulic pump 11 to the rod end oil chamber 8*b* are controlled to increase or decrease, depending on an increase or decrease in the opening area of the recovery valve passage 16*e* and the supply valve passage 16*f* associated with these spool displacements.

When the opening characteristics of a discharge valve passage 17*d* when the second boom control valve 17 is positioned at the lowering-side operating position Y is illustrated in FIG. 4B, the more a displacement amount of the spool increases, the more an opening area of the discharge valve passage 17*d* is set to increase. The discharge flow rate from the head end oil chamber 8*a* to the oil tank 15 is controlled to increase or decrease, depending on an increase or decrease in the opening area of the discharge valve passage 17*d*.

On the other hand, in the above FIG. 2, reference numeral 28 denotes a raising-side solenoid valve for outputting a pilot pressure to the raising-side pilot ports 16*b* and 17*b* of the first and second boom control valves 16 and 17; reference numeral 29 denotes a lowering-side solenoid valve for outputting a pilot pressure to the lowering-side pilot ports 16*c* and 17*c*. These raising-side and lowering-side solenoid valves 28 and 29 are operated, based on a control signal from a controller 30 discussed below, to output a pilot pressure of the pressure in response to the control signal. The spools of the first and second boom control valves 16 and 17 are displaced by pilot pressures that are output to the raising-side and lowering-side pilot ports 16*b*, 17*b*, 16*c*, and 17*c* from the raising-side and the lowering-side solenoid valves 28 and 29, and the first and second boom control valves 16 and 17 switch to be positioned at the rising-side operating position X and the lowering-side operating position Y. In this case, the displacement amount of the spool is controlled to increase or decrease depending on an increase or decrease in the pilot pressure, and the first boom control valve 16 is set to be positioned at the first region Y1 if the pilot pressure output from the lowering-side solenoid valve 29 is less than a predetermined pilot pressure Pp and is set to be positioned at the second region Y2 if the pilot pressure is higher than or equal to the predetermined pilot pressure Pp.

Reference numeral 31 denotes a pressure sensor (which corresponds to a pressure detecting means of the present invention) for detecting a pressure of the head end oil chamber 8*a* of the boom cylinder 8; 32 denotes an operation detecting means for detecting an operation of a boom operating lever (not shown). The detection signals of the pressure sensor 31 and the operation detecting means 32 are input to the controller 30. Based on these input signals, the controller 30 outputs control signals to the raising and lowering-side solenoid valves 28 and 29, thereby controlling the switching operation of the first and second boom control valves 16 and 17.

To the controller 30 are connected the operation detecting means for detecting respectively operations of the operation implements of the hydraulic actuators (the left and right traveling motors, the rotating motor, the stick cylinder 9, the bucket cylinder 10) other than the boom cylinder 8, and the solenoid valves that outputs pilot pressures to respective hydraulic actuator control valves (first control valves for left traveling, for bucket, for stick, and second control valves for right traveling, for rotating, for stick 18 to 23) in response to control signals output from the controller 30 according to the detection signals of these operation detecting means, etc., which are not illustrated in the figure, and description thereof will be omitted.

Next, the control of the first and second boom control valves 16 and 17 performed by the controller 30 will be discussed. When a boom-raising operation signal is input from the operation detecting means 32, the controller 30 outputs a control signal of a pilot pressure output to the raising-side solenoid valve 28. In this case, the controller 30 outputs a control signal so that the pilot is increased or decreased depending on an increase or decrease in an operation amount of the boom operating lever. As a result, the pilot pressure is input to the raising-side pilot ports 16*b* and 17*b* of the first and second boom control valves 16 and 17, and both the first and second boom control valves 16 and 17 switch to be positioned at the raising-side operating position X. As discussed above, the first boom control valve 16 at the raising-side operating position X allows the discharge oil of the first hydraulic pump 11 to be supplied to the head end oil chamber 8*a* of the boom cylinder 8, and allows the oil discharged from the rod end oil chamber 8*b* to flow into the oil tank 15. The second boom control valve 17 at the raising-side operating position X allows the discharge oil of the second hydraulic pump 12 to be supplied to the head end oil chamber 8*a* of the boom cylinder 8.

When the boom-lifting operation is performed, the discharge oil of the first and second hydraulic pumps 11 and 12 is supplied to the head end oil chamber 8*a* of the boom cylinder 8 via the first and second boom control valves 16 and 17 at the raising-side operating position X. In other words, when the boom is raised, the discharge oil of both the first and second hydraulic pumps 11 and 12 is supplied to the head end oil chamber 8*a*, so that even the raising operation of the boom 5, on which the weight of the front work implement 4 is being applied, can be performed quickly.

On the other hand, when a boom-lowering operation signal is input from the operation detecting means 32, the controller 30 determines whether the operation is a machine body lifting operation (an operation of lowering the boom 5 with respect to the machine body by lowering the boom 5 while the bucket 7 is touching down the ground, thereby lifting a part of the machine body), according to a pressure of the head end oil chamber 8*a* of the boom cylinder 8 input from the pressure sensor 31. Furthermore, the controller 30 determines whether an operation speed of the boom operating lever is equal to or higher than a setting speed preset as a sudden operation, based on an operation signal input from the operation detecting means 32.

Here, determination whether the operation is a machine body lifting operation, is made according to a pressure value of the head end oil chamber 8*a* of the boom cylinder 8 input from the pressure sensor 31. In other words, when the boom 5 is lowered in the air (lowering of the boom 5 while the bucket 7 is not touching down the ground), the pressure of the head end oil chamber 8*a* is high, because the total weight of the front work implement 4 is applied to the pressurized oil in the head end oil chamber 8*a* of the boom cylinder 8. On the other hand, when the boom 5 is lowered when a force that resists the lowering of the boom 5 by the bucket 7 which is touching down the ground or the like is acting, a tensile force is applied to the boom cylinder 8 so that the pressure of the head end oil chamber 8*a* is made lower than the boom-lowering in the air. However, during the machine body lifting operation, the boom 5 is lowered while resisting the weight of the machine body, so that a strong tensile force acts on the boom cylinder 8, and therefore the pressure in the head end oil chamber 8*a* is made much lower. Therefore, when the pressure of the head end oil chamber 8*a* of the boom cylinder 8 has dropped down to less than a predetermined set pressure Ps, it is determined that the operation is a machine body lifting operation, and when the pressure is higher than the set pressure Ps, it is determined that the operation is not a machine body lifting operation.

When a boom-lowering operation signal is input from the operation detecting means 32, the controller 30 outputs a control signal of pilot-pressure-output to the lowering-side solenoid valve 29, whereby a pilot pressure is input to the lowering-side pilot ports 16*c* and 17*c* of the first and second boom control valves 16 and 17, and the first and second boom control valves 16 and 17 switch to be positioned at the lowering-side operating position Y. In this case, if it is determined that the pressure of the head end oil chamber 8*a* of the boom cylinder 8 is higher than or equal to the set pressure Ps (not the machine body lifting operation), and the operation speed of the boom operating lever is less than the set speed (not sudden operation), then the controller 30 outputs a control signal to the lowering-side solenoid valve 29 so as to output a pilot pressure less than the above predetermined pilot pressure Pp, that is, a pilot pressure (a pilot pressure at which the spool displacement amount is positioned at the first region Y1) of the pressure for causing the first boom control valve 16 to be positioned at the first region Y1. In this case, the controller 30 controls an output pilot pressure from the lowering-side solenoid valve 29 so that the spool displacement amount is increased or decreased depending on an increase or decrease of an operation amount of the boom operating lever, within the range less than the predetermined pilot pressure Pp (within the range where the first boom control valve 16 is positioned at the first region Y1). As a result, the first boom control valve 16 is positioned at the first region Y1, thereby opening the recovery valve passage 16*e* that allows the oil discharged from the head end oil chamber 8*a* to be supplied to the rod end oil chamber 8*b* of the boom cylinder 8. In addition, the second boom control valve 17 switches to be positioned at the lowering-side operating position Y, thereby opening the discharge valve passage 17*d* that allows the oil discharged from the head end oil chamber 8*a* of the boom cylinder 8 to flow into the oil tank 15.

On the other hand, if it is determined that, when a signal of the boom-lowering operation is input from the operation detecting means 32, the pressure in the head end oil chamber 8*a* of the boom cylinder 8 is less than the set pressure Ps (the machine body lifting operation), or the operation speed of the boom operating lever is equal to or higher than the set speed (sudden operation), then the controller 30 outputs a control signal so as to output, to the lowering-side solenoid valve 29, a pilot pressure equal to or higher than the predetermined pilot pressure Pp, that is, a pilot pressure (a pilot pressure at which the spool displacement amount enters the second region Y2) of the pressure for causing the first boom control valve 16 to be positioned at the second region Y2. In this case, the controller 30 controls an output pilot pressure from the lowering-side solenoid valve 29 so that the spool displacement amount is increased or decreased depending on an increase or decrease in the operation amount of the boom operating lever, within the range equal to or higher than the predetermined pilot pressure Pp (within the range where the first boom control valve 16 is positioned at the second region Y2). Consequently, the first boom control valve 16 is positioned at the second region Y2, and the recovery valve passage 16*e* that allows the oil discharged from the head end oil chamber 8*a* to be supplied to the rod end oil chamber 8*b* of the boom cylinder 8 is wider opened than at the first region Y1, and the supply valve passage 16*f* that supplies the discharge oil of the first hydraulic pump 11 to the rod end oil chamber 8*b* is opened. The second boom control valve 17 opens a discharge valve passage 17*d* that allows the oil discharged from the head end oil chamber 8*a* of the boom cylinder 8 to flow into the oil tank 15, but an opening area of the discharge valve passage 17*d* becomes larger than when the output pilot pressure from the lowering-side solenoid valve 29 is less than the predetermined pilot pressure Pp.

Thus, when the boom-lowering operation is performed, if the boom cylinder 8 is not operated to lift the machine body (the pressure in the head end oil chamber 8*a* of the boom cylinder 8 is equal to or higher than the set pressure Ps), and the boom operating lever is not abruptly operated, the oil discharged from the head end oil chamber 8*a* of the boom cylinder 8 is supplied to the rod end oil chamber 8*b* as recovered oil, via the first boom control valve 16 at the first region Y1 of the lowering-side operating position Y, and a surplus of the oil discharged from the head end oil chamber 8*a* is discharged to the oil tank 15 via the second boom control valve 17 at the lowering-side operating position Y. Consequently, the boom 5 can be lowered only using the recovered oil from the head end oil chamber 8*a* to the rod end oil chamber 8*b*, without using the discharge oil of the first and second hydraulic pumps 11 and 12, thereby enabling contribution to the improvement of energy efficiency. It should be noted that the boom cylinder 8 at the time of contraction (at the time of boom-lowering) allows only the discharge amount from the head end oil chamber 8*a* to cover the supply amount to the rod end oil chamber 8*b*, which will generate a surplus portion, because the supply amount from the head end oil chamber 8*a* is approximately twice as much as the rod end oil chamber 8*b* from the relationship of a pressure-receiving area acting on the piston.

On the other hand, when the boom-lowering operation is performed, if the machine body lifting operation (the pressure of the head end oil chamber 8*a* of the boom cylinder 8 is less than the set pressure Ps) or if the boom operating lever is operated suddenly, then the oil discharged from the head end oil chamber 8*a* of the boom cylinder 8 is supplied to the rod end oil chamber 8*b*, via the first boom control valve 16 at the second region Y2 of the lowering-side operating position Y (when the head end oil chamber 8*a* is higher than the pressure of the rod end oil chamber 8*b*), and discharge oil from the first hydraulic pump 11 is supplied to the head end oil chamber 8*b* at the same time, and a surplus of the oil discharged from the head end oil chamber 8*a* is discharged to the oil tank 15 via the second boom control valve 17 at the lowering-side operating position Y. Consequently, the discharge oil of the first hydraulic pump 11 is supplied to the rod end oil chamber 8*b* of the boom cylinder 8, so that the machine body lifting operation for lowering the boom 5 while resisting the weight of the machine body can be smoothly performed. In addition, even if the boom operating lever is suddenly operated, the boom 5 can be quickly lowered without delay in response.

In the first embodiment, an oil passage, which extends from the head end oil chamber 8*a* of the boom cylinder 8 to the rod end oil chamber 8*b* passing through the recovery valve passage 16*e* of the first boom control valve 16, serves as a recovery oil passage of the present invention. An oil passage, which extends from the first hydraulic pump 11 to the rod end oil chamber 8*b* of the boom cylinder 8 passing through the supply valve passage 16*f* of the first boom control valve 16, serves as a supply oil passage of the present invention. An oil passage, which extends from the head end oil chamber 8*a* of the boom cylinder 8 to the oil tank 15 passing through the discharge valve passage 17*d* of the second boom control valve 17, serves as a discharge oil passage of the present invention. Further, in the first embodiment, the first hydraulic pump 11 corresponds to a hydraulic pump of the present invention.

In the first embodiment constructed as discussed above, the vertical movement of the boom 5 is performed based on the extending and contracting operation of the boom cylinder 8, and the hydraulic circuit of the boom cylinder 8 includes a recovery oil passage that allows the oil discharged from the head end oil chamber 8*a* to be supplied to the rod end oil chamber 8*b* of the boom cylinder 8, a discharge oil passage that allows the oil discharged from the head end oil chamber 8*a* of the boom cylinder 8 to flow into the oil tank 15, and a supply oil passage that allows the discharge oil of the first hydraulic pump 11 to be supplied to the rod end oil chamber 7*b*. In the hydraulic circuit, in providing the supply valve passage 16*f* for controlling the flow rate of the supply flow passage, in the first boom control valve 16 for controlling the flow rate of the recovery oil passage, a pressure sensor (pressure detecting means) 31 for detecting a pressure of the head end oil chamber 8*a*, an operation detecting means 32 for detecting an operation of the boom 5, and a controller 30 for controlling the first boom control valve 16 on the basis of input signals from the pressure sensor 31 and the operation detecting means 32 are provided, and the first boom control valve 16 includes a lowering-side operating position Y when the boom 5 is lowered, which includes a first region Y1 at which the supply valve passage 16*f* is closed and a second region Y2 at which the supply valve passage 16*f* is opened. The controller 30 determines whether the operation is a machine body lifting operation for lifting a part of the machine body according to a pressure of the head end oil chamber 8*a* during the lowering operation of the boom 5. If it is determined that the operation is not a machine body lifting operation, the first boom control valve 16 is positioned at the first region Y1, and if it is determined as the machine body lifting operation, the first boom control valve 16 is positioned at the second region Y2.

As a result, in case of not being a machine body lifting operation during the lowering-operation of the boom 5, the first boom control valve 16 is positioned at the first region Y1 and the supply valve passage 16*f* is closed. Consequently, only the recovered oil from the head end oil chamber 8*a* is allowed to be used, without allowing the discharge oil of the first hydraulic pump 11 to be used, for the pressurized oil supply to the rod end oil chamber 8*b* of the boom cylinder 8, thereby contributing to the improvement of energy efficiency, and an interlocking operability between the boom cylinder 8 and other hydraulic actuators (for example, the stick cylinder 9 and the bucket cylinder 10) having the same pressurized oil supply source as the boom cylinder 8. On the other hand, when the lowering operation of the boom 5 is the machine body lifting operation, the first boom control valve 16 is positioned at the second region Y2 and will open the supply valve passage 16*f*. Consequently, the discharge oil of the first hydraulic pump 11 will be supplied to the rod end oil chamber 8*a* of the boom cylinder 8, so that the machine body lifting operation while resisting the weight of the machine body will be able to be carried out smoothly.

Also in this hydraulic control circuit, when switching between a case of supplying and a case of not supplying the discharge oil of the first hydraulic pump 11 to the rod end oil chamber 8*b* of the boom cylinder 8, it is configured such that the first region Y1 and the second region Y2 are provided in the lowering-side operating position Y of the first boom control valve 16 for controlling the flow rate of the recovery oil passage during the boom-lowering operation, and at the first region Y1, the supply valve passage 16*f* is closed, at the second region Y2, the supply valve passage 16*f* is opened. Switching between a case of supplying and a case of not supplying the discharge oil of the first hydraulic pump 11 to the rod end oil chamber 8*b* becomes able to be performed, by utilizing the first boom control valve 16 necessary for controlling the recovery flow rate when the boom 5 is lowered. As a result, dedicated valves for performing the switching, and solenoid valves, etc. for operating the valves are not required, thereby enabling contribution to the reduction of number of parts, and contribution to cost saving or space saving.

Furthermore, in this hydraulic control circuit, the controller 30 is configured such that, when the boom-lowering operation is a sudden operation, the first boom control valve 16 is positioned at the second region Y2, irrespective of whether the operation is a machine body lifting operation, and the discharge oil of the first hydraulic pump 11 is supplied to the rod end oil chamber 8*b* of the boom cylinder 8, and therefore the responsiveness to a sudden operation becomes also excellent.

In the first embodiment, as discussed above, two hydraulic pumps of the first and second hydraulic pumps 11 and 12 are provided as pressurized oil supply sources of the boom cylinder 8, and the aforementioned first and second boom control valves 16 and 17 switch together to be positioned at the raising-side position X when the boom-lifting operation is performed, and supply the discharge oil of the first and second hydraulic pumps 11 and 12 respectively to the head end oil chamber 8*a* of the boom cylinder 8.

Figure 5:
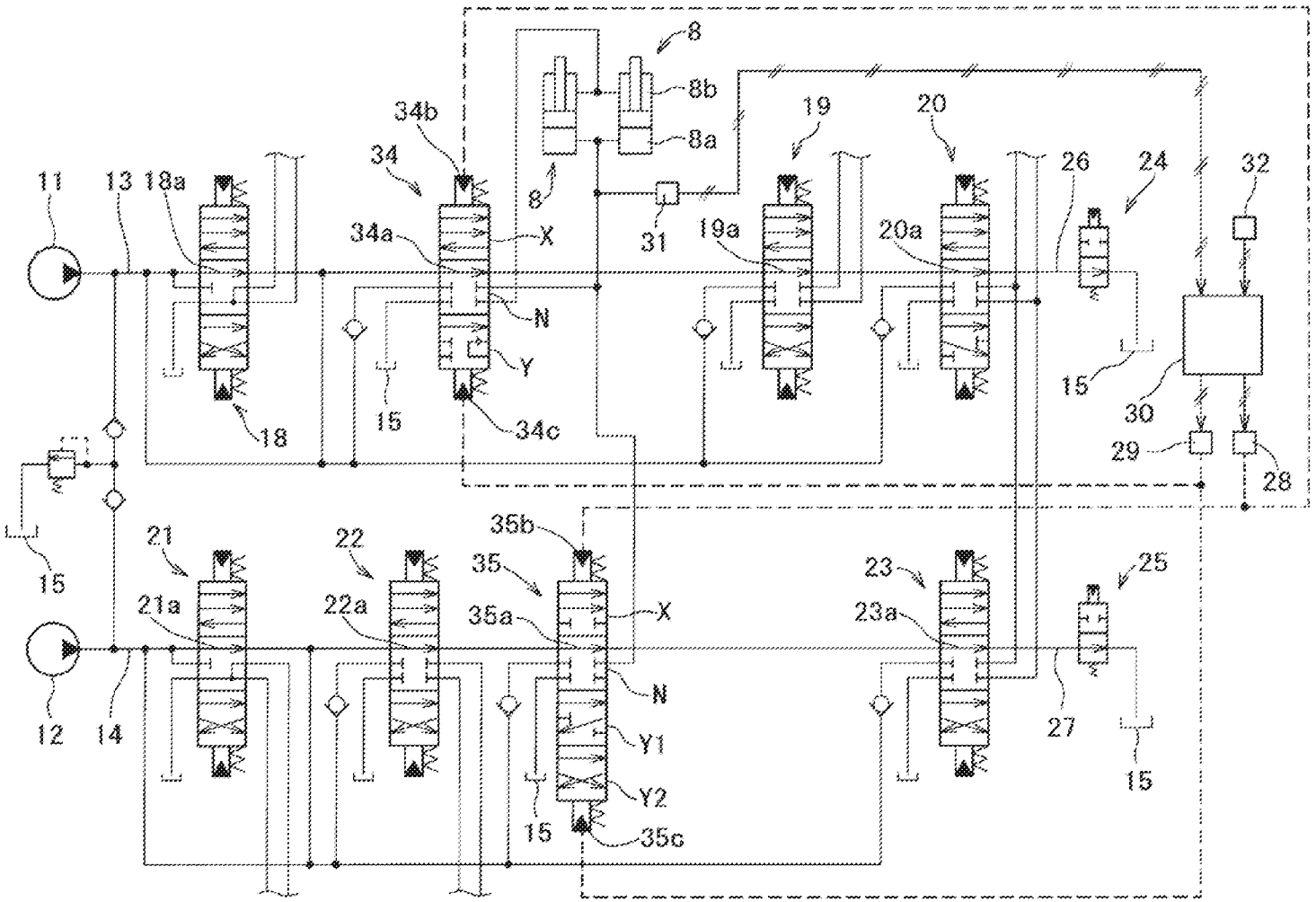
FIG. 5 is a hydraulic control circuit diagram of a boom cylinder in a second embodiment.
Figure 6C:
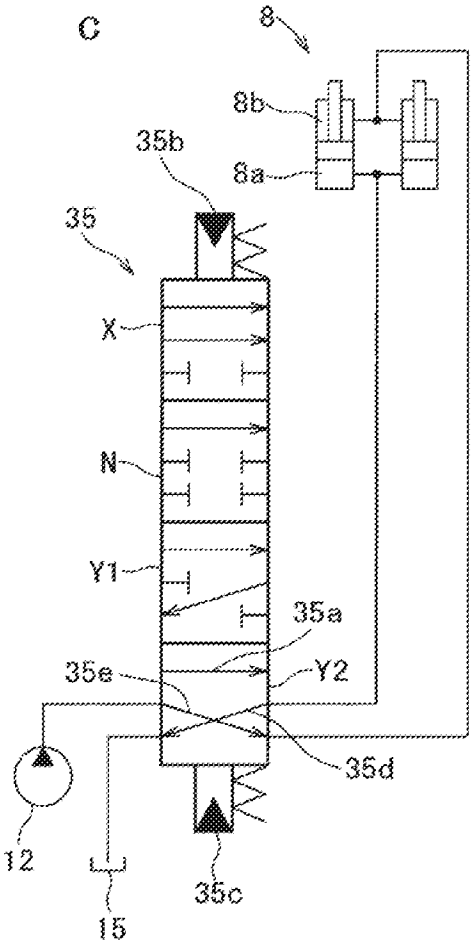
Figure 6B:
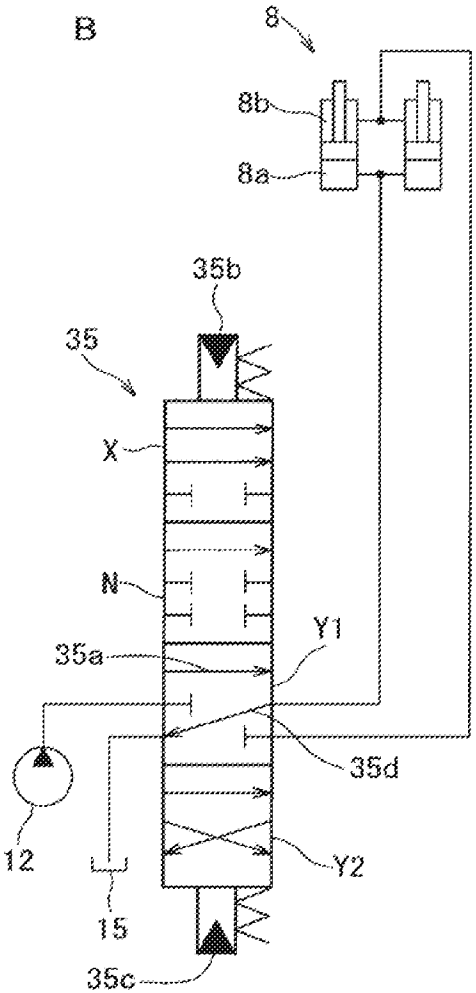
Figure 6A:
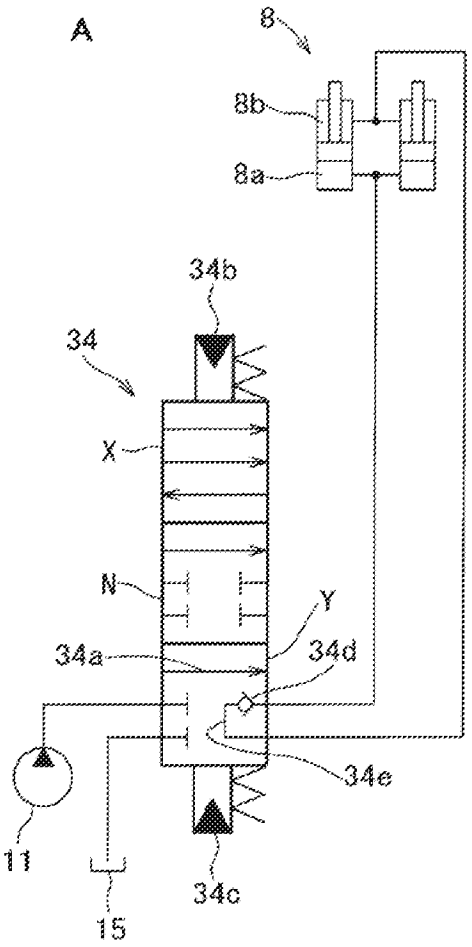

Next, a second embodiment of the present invention will be discussed with reference to FIGS. 5 to 7. FIG. 5 illustrates a hydraulic control circuit diagram of the boom cylinder 8 of the second embodiment. The components in the second embodiment are the same as those in the first embodiment except for first and second boom control valves 34 and 35, and therefore the same reference numerals will be given to them, and therefore description thereof will be omitted.

The aforementioned first boom control valve 34 of the second embodiment is a three-position switching spool valve that includes raising-side and lowering-side pilot ports 34*b* and 34*c*. The first boom control valve 34 is configured, in a state where a pilot pressure is not input to both the pilot ports 34*b* and 34*c*, to be positioned at the neutral position N at which supply and discharge of pressurized oil to the boom cylinder 8 is not performed, but to switch to be positioned at a raising-side operating position X when a pilot pressure is input to the raising-side pilot port 34*b*, and to supply the discharge oil of the first hydraulic pump 11 to the head end oil chamber 8*a* of the boom cylinder 8, and to allow the oil discharged from the rod end oil chamber 8*b* to flow into the oil tank 15. The first boom control valve 34 is configured to switch to be positioned at the lowering-side operating position Y when a pilot pressure is input to the lowering-side pilot port 34*c*, but in a state of being positioned at the lowering-side operating position Y, to open the recovery valve passage 34*e* for supplying the oil discharged from the head end oil chamber 8*a* of the boom cylinder 8 to the rod end oil chamber 8*b* via a check valve 34*d* (See FIG. 6A).

The second boom control valve 35 of the second embodiment, which is a four-position switching spool valve that includes raising-side and lowering-side pilot ports 35*b* and 35*c*. The second boom control valve 35 is positioned at the neutral position N at which supply and discharge of pressurized oil to the boom cylinder 8 is not performed, in a state where a pilot pressure is not input to both the pilot ports 35*b* and 35*c*, but to switch to be positioned at the raising-side operating position X when a pilot pressure is input to the raising-side pilot port 35*b*, and to supply the discharge oil of the second hydraulic pump 12 to the head end oil chamber 8*a* of the boom cylinder 8. Further, the second boom control valve 35 switches to be positioned at a lowering-side operating position Y when a pilot pressure is input to the lowering-side pilot port 35*c*, but a first region Y1 and a second region Y2 are provided in the lowering-side operating position Y. In this case, the second region Y2 is set up at a position at which the amount of displacement from the neutral position N is larger than that of the first region Y1. Then, in a state of being positioned at the first region Y1, a discharge valve passage 35*d* that allows the oil discharged from the head end oil chamber 8*a* of the boom cylinder 8 to flow into the oil tank 15 is opened, and on the other hand, a supply valve passage 35*e* for supplying the discharge oil of the second hydraulic pump 12 to the rod end oil chamber 8*b* is closed (see FIG. 6B). Also, the second boom control valve 35 is configured, in a state of being positioned at the second region Y2, to open the discharge valve passage 35*d* that allows the oil discharged from the head end oil chamber 8*a* of the boom cylinder 8 to flow into the oil tank 15, and the supply valve passage 35*e* that allows the discharge oil of the second hydraulic pump 12 to be supplied to the rod end oil chamber 8*b* (see FIG. 6C).

In the second embodiment, the second boom control valve 35 corresponds to a boom control valve of the present invention, but the first boom control valve does not correspond to a boom control valve of the present invention. In the above FIG. 5 and FIG. 6, reference numerals 34*a* and 35*a* denote center bypass valve passages formed in the first and second boom control valves 34 and 35 respectively. In FIG. 6, oil passages connected to these center bypass valve passages 34*a* and 35*a* will be omitted.

Figure 7A:
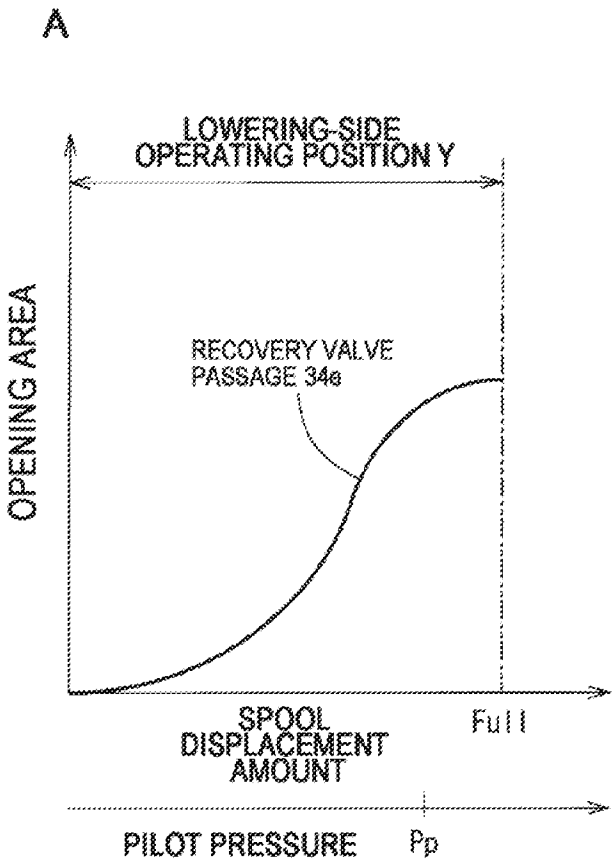

Here, the opening characteristics of the recovery valve passage 34*e* when the first boom control valve 34 is positioned at the lowering-side operating position Y is illustrated in FIG. 7A. The more a spool displacement amount increases, the more an opening area of the recovery valve passage 34*e* is set to increase. The recovery flow rate from the head end oil chamber 8*a* to the rod end oil chamber 8*b* is controlled to increase or decrease in response to an increase or decrease in the opening area of the recovery valve passage 34*e*.

Figure 7B:
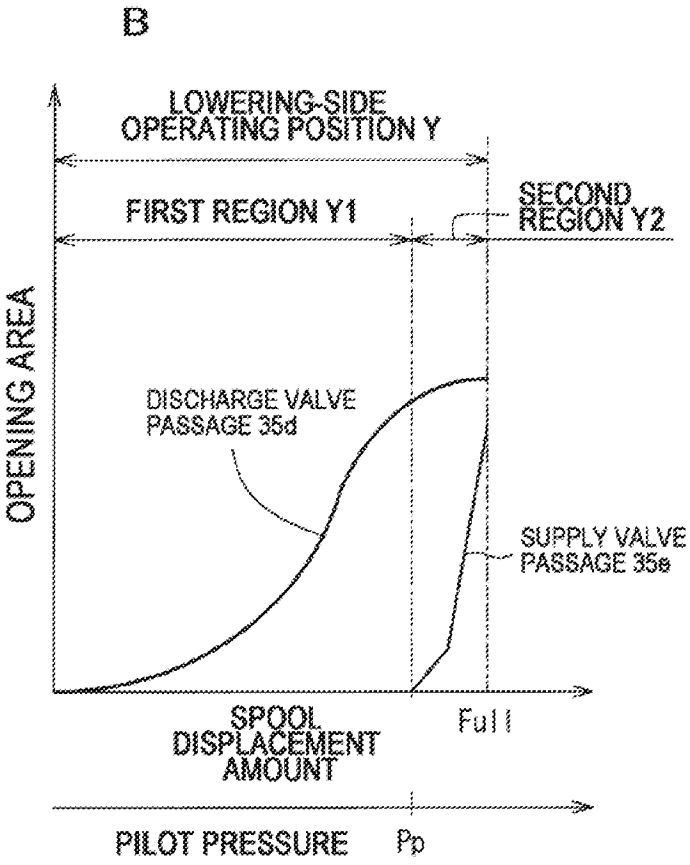

In addition, the opening characteristics of the discharge valve passage 35*d* and the supply valve passage 35*e* when the second boom control valve 35 is positioned at the first region Y1 and the second region Y2 of the lowering-side operating position Y is illustrated in FIG. 7B. As shown in FIG. 7B, at the first region Y1, only the discharge valve passage 35*d* is opened, and the more a spool displacement amount increases, the more an opening area is set to increase. Further, when the spool is further displaced beyond the first region Y1 to reach the second region Y2, the opening area of the discharge valve passage 35*d* becomes further larger and the supply valve passage 35*e* is opened, but the more a spool displacement amount increase, the more an opening area of the supply valve passage 35*e* is set to increase. The discharge flow rate from the head end oil chamber 8*a* to the oil tank 15, and the discharge flow rate from the second hydraulic pump 12 to the rod end oil chamber 8*b* are controlled to increase or decrease depending on an increase or decrease of the opening areas of the discharge valve passage 35*d* and the supply valve passage 35*e* associated with these spool displacements.

Then, the first and second boom control valves 34 and 35 are controlled based on control signals output from the controller 30, similarly to the first embodiment, but the controller 30 outputs a control signal of a pilot pressure output to the raising-side solenoid valve 28, when a signal of the boom-raising operation is input from the operation detecting means 32. Consequently, both the first and second boom control valves 34 and 35 switch to be positioned both at the raising-side operating position X, and similarly to the first embodiment, the discharge oil of both the first and second hydraulic pumps 11 and 12 is supplied to the head end oil chamber 8*a*.

On the other hand, when a signal of the boom-lowering operation is input from the operation detecting means 32, the controller 30, similarly to the first embodiment, determines whether the operation is a machine body lifting operation, and determines whether the boom-lowering operation is a sudden operation. If it is determined that the operation is neither the machine body lifting operation nor the sudden operation, the controller 30 outputs a control signal so as to output a pilot pressure equal to or higher than the predetermined pilot pressure Pp, that is, a pilot pressure (a pilot pressure at which the spool displacement amount enters the first region Y1) of the pressure for causing the second boom control valve 35 to be positioned at the first region Y1, to the lowering-side solenoid valve 29. Consequently, the second boom control valve 35, which is positioned at the first region Y1, opens the discharge valve passage 35*d* that allows the oil discharged from the head end oil chamber 8*a* of the boom cylinder 8 to flow into the oil tank 15. The first boom control valve 34 is positioned at the lowering-side operating position Y, to open the recovery valve passage 34*e* that supplies the oil discharged from the head end oil chamber 8*a* of the boom cylinder 8 to the rod end oil chamber 8*b*.

On the contrary, when a signal of the boom-lowering operation is input from the operation detecting means 32, if it is determined that the operation is a machine body lifting operation or a sudden operation, the controller 30 outputs a control signal so as to output a pilot pressure equal to or higher than the predetermined pilot pressure Pp, that is, a pilot pressure (a pilot pressure at which a spool displacement amount enters the second region Y2) of the pressure for allowing the second boom control valve 35 to be positioned at the second region Y2, to a lowering-side solenoid valve 29. Consequently, the second boom control valve 35 is positioned at the second region Y2, and is wider opened than at the first region Y1, the discharge valve passage 35*d* that allows the oil discharged from the head end oil chamber 8*a* of the boom cylinder 8 to flow into the oil tank 15, and opens the supply valve passage 35*e* that allows the discharge oil of the second hydraulic pump 12 to be supplied to the rod end oil chamber 8*b*. The first boom control valve 34 is positioned at the lowering-side operating position Y so as to open the recovery valve passage 34*e* that allows the oil discharged from the head end oil chamber 8*a* to be supplied to the rod end oil chamber 8*b* of the boom cylinder 8, but an opening area of the recovery valve passage 34*e* becomes larger than when an output pilot pressure from the lowering-side solenoid valve 29 is less than the predetermined pilot pressure Pp.

Thus, when the boom-lowering operation is performed, if the operation is not the machine body lifting operation, and the boom operating lever is not suddenly operated, the oil discharged from the head end oil chamber 8*a* of the boom cylinder 8 is supplied to the rod end oil chamber 8*b* as the recovered oil, via the first boom control valve 34 at the lowering-side operating position Y, and a surplus of the oil discharged from the head end oil chamber 8*a* is discharged to the oil tank 15 via the second boom control valve 35 at the first region in the lowering-side operating position Y. On the other hand, when the boom-lowering operation is performed, if the operation is a machine body lifting operation or a sudden operation, the oil discharged from the head end oil chamber 8*a* of the boom cylinder 8 is supplied to the rod end oil chamber 8*b* via the first boom control valve 34 at the lowering-side operating position Y, and the discharge oil from the second hydraulic pump 12 is supplied to the rod end oil chamber 8*b* via the second boom control valve 35 at the second region Y2 in the lowering-side operating position Y. Also, a surplus of the oil discharged from the head end oil chamber 8*a* is discharged to the oil tank 15 via the second boom control valve 35 at the second region Y2 in the lowering-side operating position Y.

In the second embodiment, an oil passage that extends from the head end oil chamber 8*a* of the boom cylinder 8 to the rod end oil chamber 8*b* passing through the recovery valve passage 34*e* of the first boom control valve 34 serves as a recovery oil passage of the present invention. Further, an oil passage that extends from the second hydraulic pump 12 to the rod end oil chamber 8*b* of the boom cylinder 8 passing through the supply valve passage 35*e* of the second boom control valve 35 serves as a supply oil passage of the present invention. Further, an oil passage that extends from the head end oil chamber 8*a* of the boom cylinder 8 to the oil tank 15 passing through the discharge valve passage 35*d* of the second boom control valve 35 serves as a discharge oil passage of the present invention. Further, in the second embodiment, the second hydraulic pump 12 corresponds to a hydraulic pump of the present invention.

Further, in the hydraulic control circuit of the second embodiment constructed as discussed above, similarly to the above first embodiment, when the lowering operation of the boom 5 is neither a machine body lifting operation and nor a sudden operation, only the recovered oil from the head end oil chamber 8*a* is used for supplying the pressurized oil to the rod end oil chamber 8*b* of the boom cylinder 8. On the other hand, when the lowering operation of the boom 5 is a machine body lifting operation or a sudden operation, the discharge oil of the second hydraulic pump 12 is supplied to the rod end oil chamber 8*b*, in addition to the recovered oil from the head end oil chamber 8*a*, and thus the same operational effects as those of the first embodiment are exhibited. In the hydraulic control circuit of the second embodiment, however, it is configured to allow switching between a case of supplying and a case of not supplying the discharge oil of the second hydraulic pump 12 to the rod end oil chamber 8*b* to be performed, by providing the first and second regions Y1 and Y2 in the lowering-side operating position Y of the second boom control valve 35 that controls the flow rate of the discharge oil passage when the boom 5 is lowered. Therefore, also in the hydraulic control circuit of the second embodiment, there is no need for dedicated valves for performing the switching, and solenoid valves etc. for operating the valves, thereby enabling contribution to the reduction of the number of parts, and contribution to cost saving and space saving.

Figure 8:
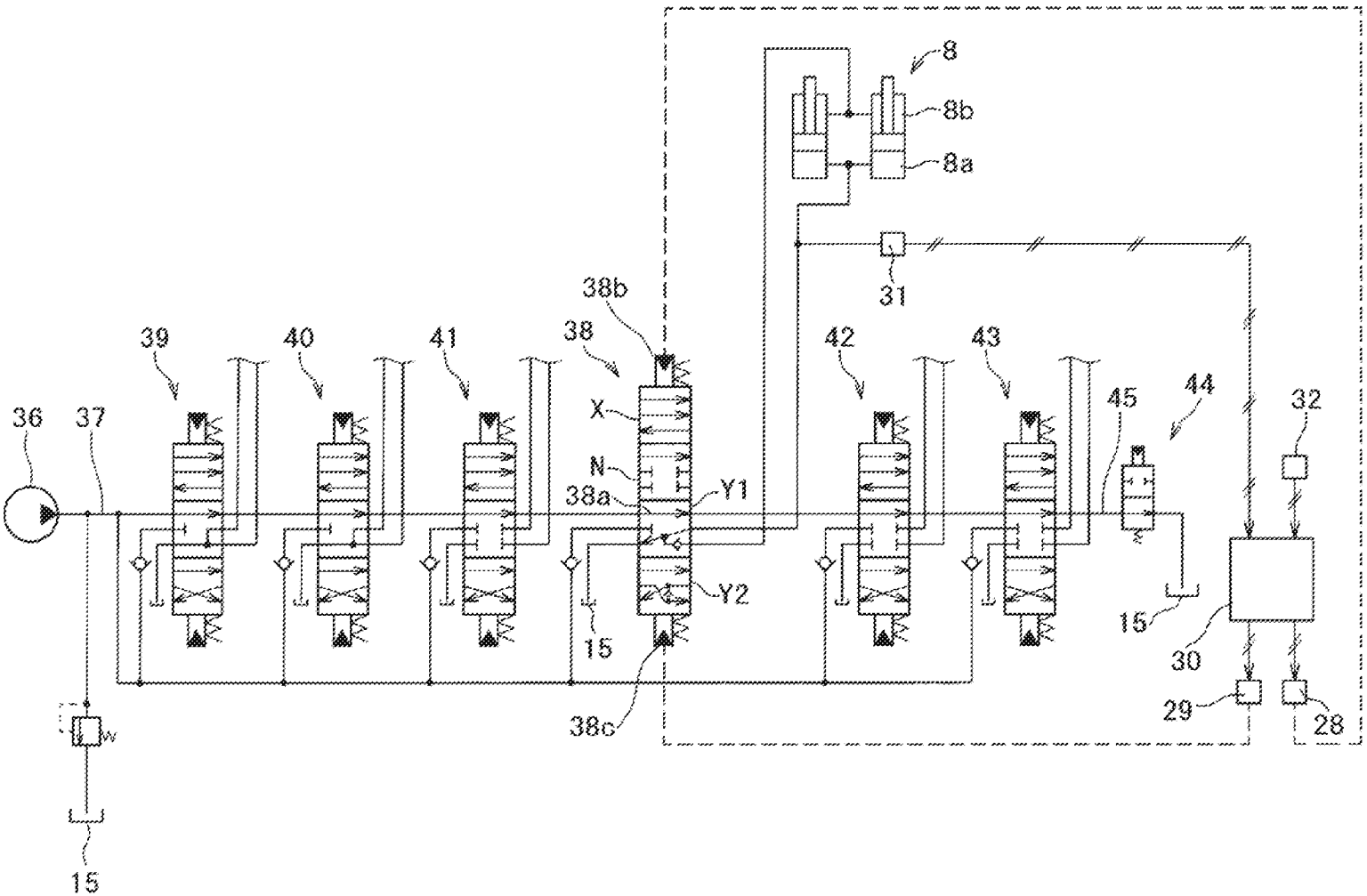
FIG. 8 is a hydraulic control circuit diagram of a boom cylinder in a third embodiment.
Figure 9B:
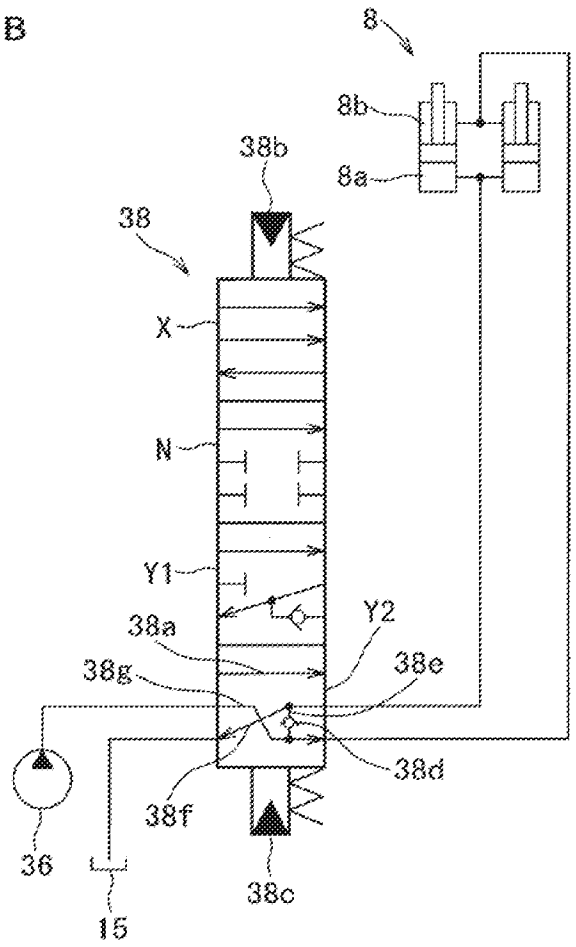
Figure 9A:
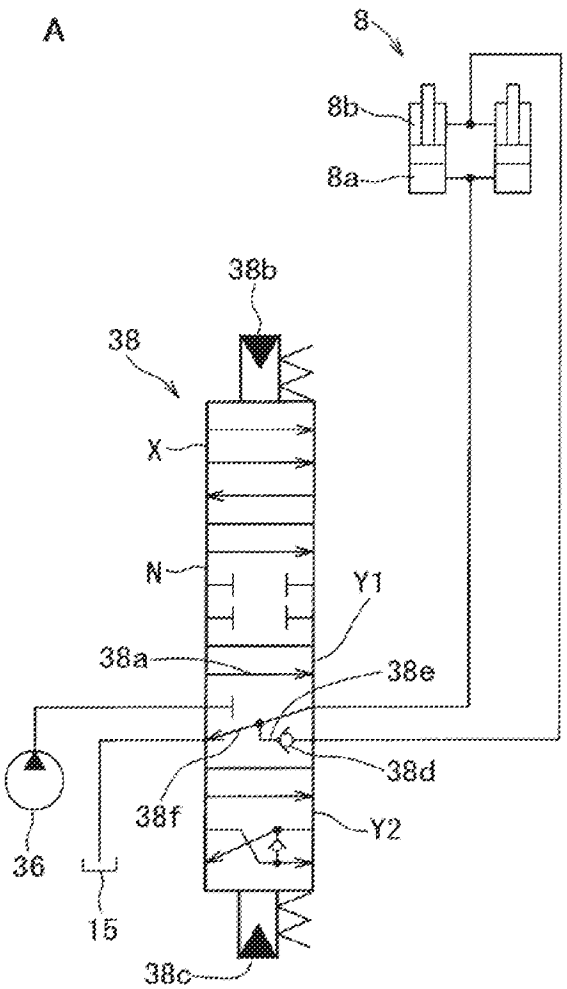

Next, a third embodiment of the present invention will be discussed with reference to FIG. 8 and FIG. 9. FIG. 8 illustrates a hydraulic control circuit diagram of the boom cylinder 8 of the third embodiment. In the third embodiment, however, there is only one hydraulic pump 36 serving as a hydraulic pressure supply source of the boom cylinder 8. A boom control valve 38 for controlling supply and discharge of oil to and from the boom cylinder 8 is connected to a pump oil passage 37 to which the discharge oil of the hydraulic pump 36 is supplied.

In FIG. 8, reference numerals 39 to 43 denote control valves for a left traveling, a right traveling, for rotating, for stick, and for bucket that performs control of supply and discharge of oil to and from the left and right traveling motors, the rotating motor, the stick cylinder 9, and the bucket cylinder 10, respectively. A reference numeral 44 denotes a center bypass control valve 44 for controlling a flow rate of a center bypass oil passage 45, but description thereof will be omitted. In the third embodiment, the same reference numerals are assigned to components similar to those in the first embodiment, and therefore description thereof will be omitted.

The boom control valve 38 of the third embodiment is a four-position switching spool valve that includes raising-side and lowering-side pilot ports 38*b* and 38*c*. The boom control valve 38 is configured, in a state where a pilot pressure is input to both the pilot ports 38*b* and 38*c*, to be positioned at the neutral position N at which supply and discharge of pressurized oil to and from the boom cylinder 8 is not performed, but to switch to be positioned at a raising-side operating position X when a pilot pressure is input to the raising-side pilot port 38*b*, and to supply the discharge oil of the hydraulic pump 36 to the head end oil chamber 8*a* of the boom cylinder 8, and to allow the oil discharged from the rod end oil chamber 8*b* to flow into the oil tank 15. In addition, the boom control valve 38 switches to be positioned at a lowering-side operating position Y when a pilot pressure is input to the lowering-side pilot port 38*c*, but a first region Y1 and a second region Y2 are provided in the lowering-side operating position Y. In this case, the second region Y2 is set up at a position at which the amount of displacement from the neutral position N is larger than that of the first region Y1. The boom control valve 38, in a state of being positioned at the first region Y1, opens a recovery valve passage 38*e* that allows the oil discharged from the head end oil chamber 8*a* to be supplied to the rod end oil chamber 8*b* of the boom cylinder 8 via a check valve 38*d*, and opens a discharge valve passage 38*a* that allows a surplus of the oil discharged from the head end oil chamber 8*a* to flow into the oil tank 15, and on the other hand, a supply valve passage 38*g* that allows the discharge oil of the hydraulic pump 36 to be supplied to the rod end oil chamber 8*b* is closed (see FIG. 9A). Further, the boom control valve 38 is configured, in a state of being positioned at the second region Y2, to open the recovery valve passage 38*e* that allows the oil discharged from the head end oil chamber 8*a* to be supplied to the rod end oil chamber 8*b* via the check valve 38*d*, and a discharge valve passage 38*f* that allows a surplus of the oil discharged from the head end oil chamber 8*a* to flow into the oil tank 15, and to open the supply valve passage 38*g* that allows the discharge oil from the hydraulic pump 36 to be supplied to the rod end oil chamber 8*b* (See FIG. 9B).

In the above FIG. 8 and FIG. 9, reference numeral 38*a* denotes a center bypass valve passage formed in the boom control valve 38. In FIG. 9, oil passages connected to the center bypass valve passage 38*a* are omitted.

Figure 10:
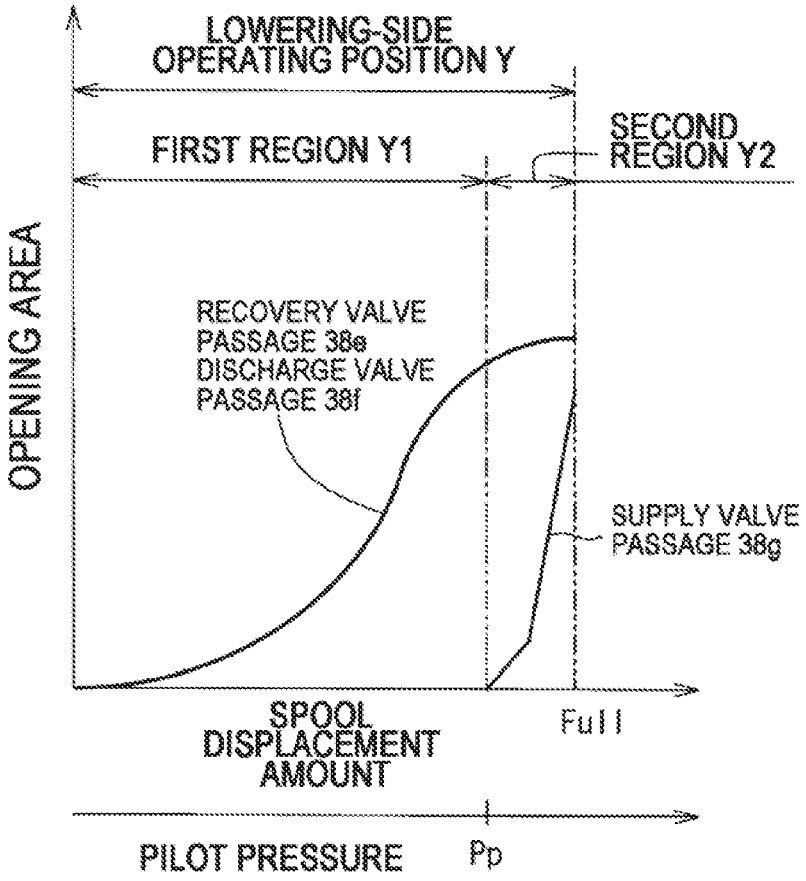
FIG. 10 is a diagram illustrating the third embodiment, and is a diagram explaining opening characteristics of first and second region at the lowering-side operating position of the boom control valve.

Here, the opening characteristics of the recovery valve passage 38*e*, the discharge valve passage 38*f*, and the supply valve passage 38*g* when the boom control valve 38 is positioned at the first region Y1 and the second region Y2 of the lowering-side operating position Y are shown in FIG. 10. As illustrated in FIG. 10, at the first region Y1, the recovery valve passage 38*e* and the discharge valve passage 38*f* are opened, and the more a spool displacement amount increases, the more an opening area is set to increase. When the spool is further displaced beyond the first region Y1 to reach the second region Y2, the opening areas of the recovery valve passage 38*e* and the discharge valve passage 38*f* are still more increased, and the supply valve passage 38*g* is opened, but the more a spool displacement amount increases, the more an opening area of the supply valve passage 38*g* is set to increase. An increase or decrease control of the recovery flow rate from the head end oil chamber 8*a* to the rod end oil chamber 8*b*, the discharge flow rate from the side oil chamber 8*a* to the oil tank 15, and the supply flow rate from the hydraulic pump 36 to the rod end oil chamber 8*b* is performed depending on an increase or decrease in the opening areas of the recovery valve passage 38*e*, the discharge valve passage 38*f* and the supply valve passage 38*g* associated with these spool displacements.

The boom control valve 38, similarly to the first and second embodiments, is controlled based on control signals output from the controller 30. However, the controller 30 outputs a control signal of a pilot pressure output from the raising-side solenoid valve 28, when a signal of the boom-raising operation is input from the operation detecting means 32. Consequently, the boom control valve 38 switches to be positioned at the raising-side operating position X, and the discharge oil of the hydraulic pump 36 is supplied to the head end oil chamber 8*a*.

On the other hand, when a signal of the boom-lowering operation is input from the operation detecting means 32, the controller 30, similarly to the first and second embodiments, determines whether the operation is a machine body lifting operation, and determines whether the boom-lowering operation is a sudden operation. If it is determined as neither the machine body lifting operation nor the sudden operation, the controller 30 outputs a control signal to output a pilot pressure of the pressure less than the predetermined pilot pressure Pp, that is, a pilot pressure (a pilot pressure at which the spool displacement amount enters the first region Y1) of the pressure for causing the boom control valve 38 to be positioned at the first region Y1, to the lowering-side solenoid valve 29. Consequently, the boom control valve 38 is positioned at the first region Y1 to open the recovery valve passage 38*e* that allows the oil discharged from the head end oil chamber 8*a* to be supplied to the rod end oil chamber 8*b* of the boom cylinder 8, and the discharge valve passage 38*f* that allows the oil discharged from the head end oil chamber 8*a* to flow into the oil tank 15.

Contrary to this, when a signal of the boom-lowering operation is input from the operation detecting means 32, if it is determined as a machine body lifting operation or a sudden operation, the controller 30 outputs a control signal so as to output a pilot pressure equal to or higher than the predetermined pilot pressure Pp, that is, a pilot pressure (a pilot pressure at which the spool displacement amount enters the second region Y2) of the pressure for causing the boom control valve 38 to be positioned at the second region Y2, to the lowering-side solenoid valve 29. Consequently, the boom control valve 38 is positioned at the second region Y2, and is wider opened than at the first region Y1, the recovery valve passage 38*e* that allows the oil discharged from the head end oil chamber 8*a* to be supplied to the rod end oil chamber 8*b* of the boom cylinder 8, and the discharge valve passage 38*f* that allows the oil discharged from the head end oil chamber 8*a* to flow into the oil tank 15, and opens the supply valve passage 38*g* that allows the discharge oil of the hydraulic pump 36 to be supplied to the rod end oil chamber 8*b*.

When the boom-lowering operation is performed, if the operation is not a machine body lifting operation, and the boom operating lever is not suddenly operated, the oil discharged from the head end oil chamber 8*a* of the boom cylinder 8 is supplied as the recovered oil to the rod end oil chamber 8*b*, via the boom control valve 38 at the first region Y1 in the lowering-side operating position Y, and a surplus of the oil discharged from the head end oil chamber 8*a* is discharged into the oil tank 15. On the other hand, when the boom-lowering operation is performed, if the operation is a machine body lifting operation or a sudden operation, the oil discharged from the head end oil chamber 8*a* of the boom cylinder 8 is supplied to the rod end oil chamber 8*b*, via the boom control valve 38 at the second region Y2 in the lowering-side operating position Y, and further the discharge oil from the hydraulic pump 36 is supplied to the rod end oil chamber 8*b*, and a surplus of the oil discharged from the head end oil chamber 8*a* is discharged to the oil tank 15.

In the third embodiment, an oil passage that extends from the head end oil chamber 8*a* of the boom cylinder 8 to the rod end oil chamber 8*b* passing through the recovery valve passage 38*e* of the boom control valve 38 serves as a recovery oil passage of the present invention, and an oil passage that extends from the hydraulic pump 36 to the rod end oil chamber 8*b* of the boom cylinder 8 passing through the supply valve passage 38*g* of the boom control valve 38 serves as a supply oil passage of the present invention, and an oil passage that extends from the head end oil chamber 8*a* of the boom cylinder 8 to the oil tank 15 passing through the discharge valve passage 38*f* of the boom control valve 38 serves as a discharge oil passage of the present invention.

Also, in the hydraulic control circuit of the third embodiment constructed as discussed above, similarly to the first and second embodiments as discussed above, if the lowering operation of the boom 5 is neither a machine body lifting operation nor a sudden operation, only the recovered oil from the head end oil chamber 8*a* is used to supply the pressurized oil to the rod end oil chamber 8*b* of the boom cylinder 8. On the other hand, if the operation is a machine body lifting operation or a sudden operation, the discharge oil of the hydraulic pump 36 in addition to the recovered oil from the head end oil chamber 8*a* is supplied to the rod end oil chamber 8*b*, and thus the similar action effects to those of the first and second embodiments are exhibited.

However, in the hydraulic control circuit of the third embodiment, it is configured to perform switching between supplying and not supplying the discharge oil of the hydraulic pump 36 to the rod end oil chamber 8*b*, by providing two regions of the first region Y1 and the second region Y2 in the lowering-side operating position Y of the boom control valve 38 for controlling the flow rates of the recovery oil passage and the supply oil passage during the lowering operation of the boom 5. Therefore, also in the hydraulic control circuit of the third embodiment, there is no need for dedicated valves for performing the above switching, and solenoid valves etc. for operating the valves, thereby contributing to the reduced number of parts, and contributing to cost saving and space saving.

It goes without saying that the present invention is not limited to the first to third embodiments. For example, the first boom control valve 16, the second boom control valve 17, the first boom control valve 34, the second boom control valve 35, and the boom control valve 38 provided in the first to third embodiments are all pilot-operated spool valves switched according to a pilot pressure, but these control valves can also be configured by using spool valves of electromagnetic proportional type in which control signals from the controller are directly input.

Further, in the first and second embodiments, the first and second boom control valves 16 and 17 (or 34 and 35) are provided as control valves for controlling supply and discharge of oil to and from the boom cylinder 8, and it is configured such that a pilot pressure is output from the common raising-side, lowering-side solenoid valves 28 and 29 to the raising-side, lowering-side pilot ports 16*b*, 16*c*, 17*b*, 17*c* (or 34*b*, 34*c*, 35*b*, 35*c*) of the first boom and second control valves 16, 17 (or 34, 35). However, in a case where a plurality of boom control valves is provided in this manner, it may be configured to provide individually a raising-side, lowering-side solenoid valve for each control valve.

In determining, according to a pressure of the head end oil chamber during the boom lowering operation, whether the operation is a machine body lifting operation, it is configured to determine according to a pressure value of the head end oil chamber of the boom cylinder in the first to third embodiments. However, it may be configured to detect pressures not only in the head end oil chamber but also in the rod end oil chamber and determine whether the operation is a machine body lifting operation according to a differential pressure between the two oil chambers.

Furthermore, it goes without saying that the present invention can be applied not only to hydraulic shovels but also to various construction machines equipped with a boom.

INDUSTRIAL APPLICABILITY

The present invention can be applied to a boom control system of a construction machine such as a hydraulic shovel equipped with a boom.

REFERENCE SIGNS LIST

5 boom
8 boom cylinder
8*a* head end oil chamber
8*b* rod end oil chamber
11 first hydraulic pump
12 second hydraulic pump
15 oil tank
16 first boom control valve
16*e* recovery valve passage
16*f* supply valve passage
30 controller
31 pressure sensor
32 operation detecting means
35 second boom control valve
35*d* discharge valve passage
35*e* supply valve passage
36 hydraulic pump
38 boom control valve
38*e* recovery valve passage
38*f* discharge valve passage
38*g* supply valve passage
Y1 first region
Y2 second region

The invention claimed is:

1. A boom control system in a construction machine, the construction machine including a boom that vertically moves based on extending and contracting operation of a boom cylinder, the boom control system including:

a recovery oil passage that allows oil discharged from a head end oil chamber to be supplied to a rod end oil chamber of a boom cylinder during a boom lowering operation;

a discharge oil passage that allows oil discharged from the head end oil chamber of the boom cylinder to flow into an oil tank;

a supply oil passage that allows discharge oil of a hydraulic pump to be supplied to the rod end oil chamber;

a supply valve passage that controls the flow rate of the supply oil passage, the supply valve passage provided on a boom control valve which controls the flow rate of the recovery oil passage or the discharge oil passage;

a pressure detecting means for detecting a pressure in the head end oil chamber of the boom cylinder;

an operation detecting means for detecting an operation of the boom; and a controller for controlling the boom control valve based on input signals from the pressure detecting means and the operation detecting means, wherein the boom control valve is provided with a first region at which the supply valve passage is closed and a second region at which the supply valve passage is opened, wherein the boom control valve is in an operating position during boom-lowering operation, wherein the controller determines whether the operation is a machine body lifting operation for lifting a part of the machine body based on a pressure of the head end oil chamber during boom lowering operation, and wherein if it is determined that the operation is not a machine body lifting operation, the boom control valve is positioned at the first region, and if it is determined that the operation is a machine body lifting operation, the boom control valve is positioned at the second region.

2. The boom control system in the construction machine, according to claim 1, wherein the controller, if the boom-lowering operation is a sudden operation, causes the boom control valve to be positioned at the second region, irrespective of determination whether the operation is a machine body lifting operation.

3. A boom control system in a construction machine, the construction machine including a boom that vertically moves based on extending and contracting operation of a boom cylinder, the boom control system including:

a recovery oil passage that allows oil discharged from a head end oil chamber to be supplied to a rod end oil chamber of a boom cylinder during a boom lowering operation;

a discharge oil passage that allows oil discharged from the head end oil chamber of the boom cylinder to flow into an oil tank;

a supply oil passage that allows discharge oil of a hydraulic pump to be supplied to the rod end oil chamber;

a supply valve passage that controls the flow rate of the supply oil passage, the supply valve passage provided on a boom control valve which controls the flow rate of the recovery oil passage or the discharge oil passage;

a pressure detecting means for detecting a pressure in the head end oil chamber of the boom cylinder;

an operation detecting means for detecting an operation of the boom; and a controller for controlling the boom control valve based on input signals from the pressure detecting means and the operation detecting means, wherein the boom control valve is provided with a first region at which the supply valve passage is closed and a second region at which the supply valve passage is opened, wherein the boom control valve is in an operating position during boom-lowering operation, wherein the controller determines whether the operation is a machine body lifting operation for lifting a part of the machine body based on a pressure of the head end oil chamber during boom lowering operation, and wherein if it is determined that the operation is not a machine body lifting operation, the boom control valve is positioned at the first region, and if it is determined that the operation is a machine body lifting operation, the boom control valve is positioned at the second region.

4. The boom control system in the construction machine, according to claim 3, wherein the controller, if the boom-lowering operation is a sudden operation, causes the boom control valve to be positioned at the second region, irrespective of determination whether the operation is a machine body lifting operation.

* * * * *